US011441249B2

(12) United States Patent
Meir

(10) Patent No.: US 11,441,249 B2
(45) Date of Patent: Sep. 13, 2022

(54) KNITTING MACHINE WITH EXTREME RACKING AND RELATED KNITTED COMPONENT

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 232 days.

(21) Appl. No.: 16/709,266

(22) Filed: Dec. 10, 2019

(65) Prior Publication Data

US 2020/0181816 A1 Jun. 11, 2020

Related U.S. Application Data

(60) Provisional application No. 62/777,566, filed on Dec. 10, 2018.

(51) Int. Cl.

| | |
|---|---|
| ***D04B 15/56*** | (2006.01) |
| ***D04B 7/04*** | (2006.01) |
| ***D04B 7/30*** | (2006.01) |
| ***D04B 15/48*** | (2006.01) |
| ***D04B 15/70*** | (2006.01) |

(52) U.S. Cl.

CPC ..... *D04B 15/56* (2013.01); *D04B 7/04* (2013.01); *D04B 7/30* (2013.01); *D04B 15/48* (2013.01); *D04B 15/70* (2013.01); *D10B 2403/032* (2013.01); *D10B 2501/043* (2013.01)

(58) Field of Classification Search

CPC . D04B 15/56; D04B 7/04; D04B 7/30; D04B 15/48; D04B 15/66; D04B 15/70

See application file for complete search history.

(56) References Cited

U.S. PATENT DOCUMENTS

| | | | | |
|---|---|---|---|---|
| 7,222,504 | B2 | 5/2007 | Nakayama | |
| 8,448,474 | B1 * | 5/2013 | Tatler | A43B 23/0205 66/64 |
| 8,522,577 | B2 | 9/2013 | Huff | |
| 8,973,410 | B1 * | 3/2015 | Podhajny | A43B 23/04 66/177 |

(Continued)

FOREIGN PATENT DOCUMENTS

| | | | |
|---|---|---|---|
| DE | 29 38 388 | A1 | 4/1981 |
| WO | WO 2015/116294 | A1 | 8/2015 |
| WO | WO 2015/134648 | A1 | 9/2015 |

OTHER PUBLICATIONS

International Search Report and Written Opinion dated Apr. 20, 2020 for PCT Application No. PCT/US2019/065391, 15 pages.

(Continued)

*Primary Examiner* — Danny Worrell

(74) *Attorney, Agent, or Firm* — Shook Hardy & Bacon, L.L.P.

(57) ABSTRACT

A method may include knitting a first portion of a knitted component on a first region of a knitting machine, knitting a second portion of the knitted component on a second region of the knitting machine, moving the first portion of the knitted component towards the second portion of the knitted component by moving a first needle bed of the knitting machine relative to a second needle bed of the knitting machine, and knitting at least one course with the knitting machine that connects the first portion of the knitted component to the second portion of the knitted component.

12 Claims, 5 Drawing Sheets

(56) References Cited

U.S. PATENT DOCUMENTS

| | | | | |
|---|---|---|---|---|
| 9,060,570 | B2 | 6/2015 | Huff et al. | |
| 9,890,485 | B2 * | 2/2018 | Podhajny | A43B 23/024 |
| 11,122,850 | B2 * | 9/2021 | Hutchinson | A43B 23/0265 |
| 11,186,930 | B2 * | 11/2021 | Huffa | A43B 23/0235 |
| 2008/0110048 | A1 * | 5/2008 | Dua | A43C 1/04 36/45 |

OTHER PUBLICATIONS

International Preliminary Report on Pantentability received for PCT Patent Application No. PCT/US2019/065391, dated Jun. 24, 2021, 10 pages.

* cited by examiner

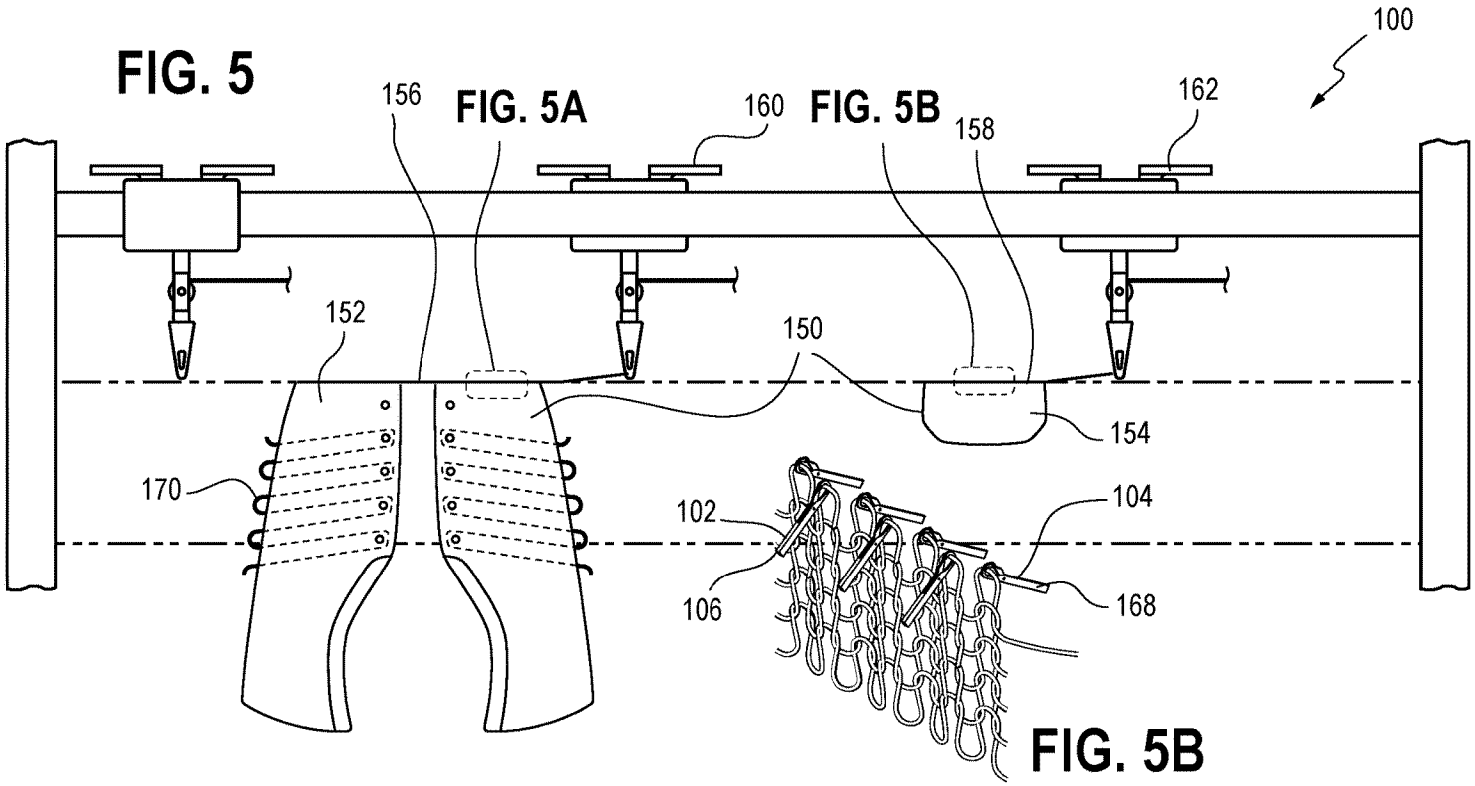
FIG. 5
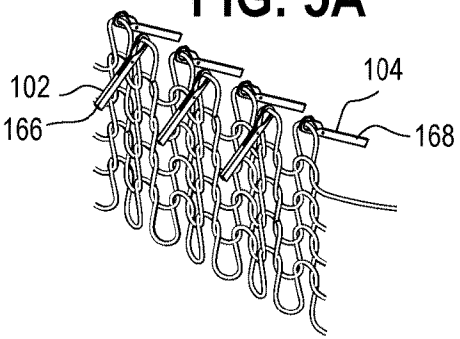
FIG. 5B
FIG. 5A

KNITTING MACHINE WITH EXTREME RACKING AND RELATED KNITTED COMPONENT

RELATED APPLICATIONS

This application claims priority to U.S. Provisional Application Ser. No. 62/777,566, filed Dec. 10, 2018, which is hereby incorporated by reference in its entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Knitting is an example of a process that may form a textile. Knitting may generally be classified as either weft knitting or warp knitting. In both weft knitting and warp knitting, one or more yarns are manipulated to form a plurality of intermeshed loops that define a variety of courses and wales. In weft knitting, which is more common, the courses and wales are perpendicular to each other and may be formed from a single yarn or many yarns. In warp knitting, the wales and courses run roughly parallel.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds. Standard feeders have the ability to supply a yarn that is utilized to knit, tuck, and float. In situations where an inlay yarn is incorporated into a knitted component, an inlay feeder is typically utilized.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure.

FIG. 5 is an illustration showing first and second portions of an upper being formed separately on a knitting machine in accordance with certain aspects of the present disclosure.

FIG. 5A is an illustration showing two needle beds forming a double jersey knit structure in the area indicated in FIG. 5 in accordance with certain aspects of the present disclosure.

FIG. 5B is an illustration showing two needle beds forming a double jersey knit structure in the area indicated in FIG. 5 in accordance with certain aspects of the present disclosure.

DETAILED DESCRIPTION

Figure 1:
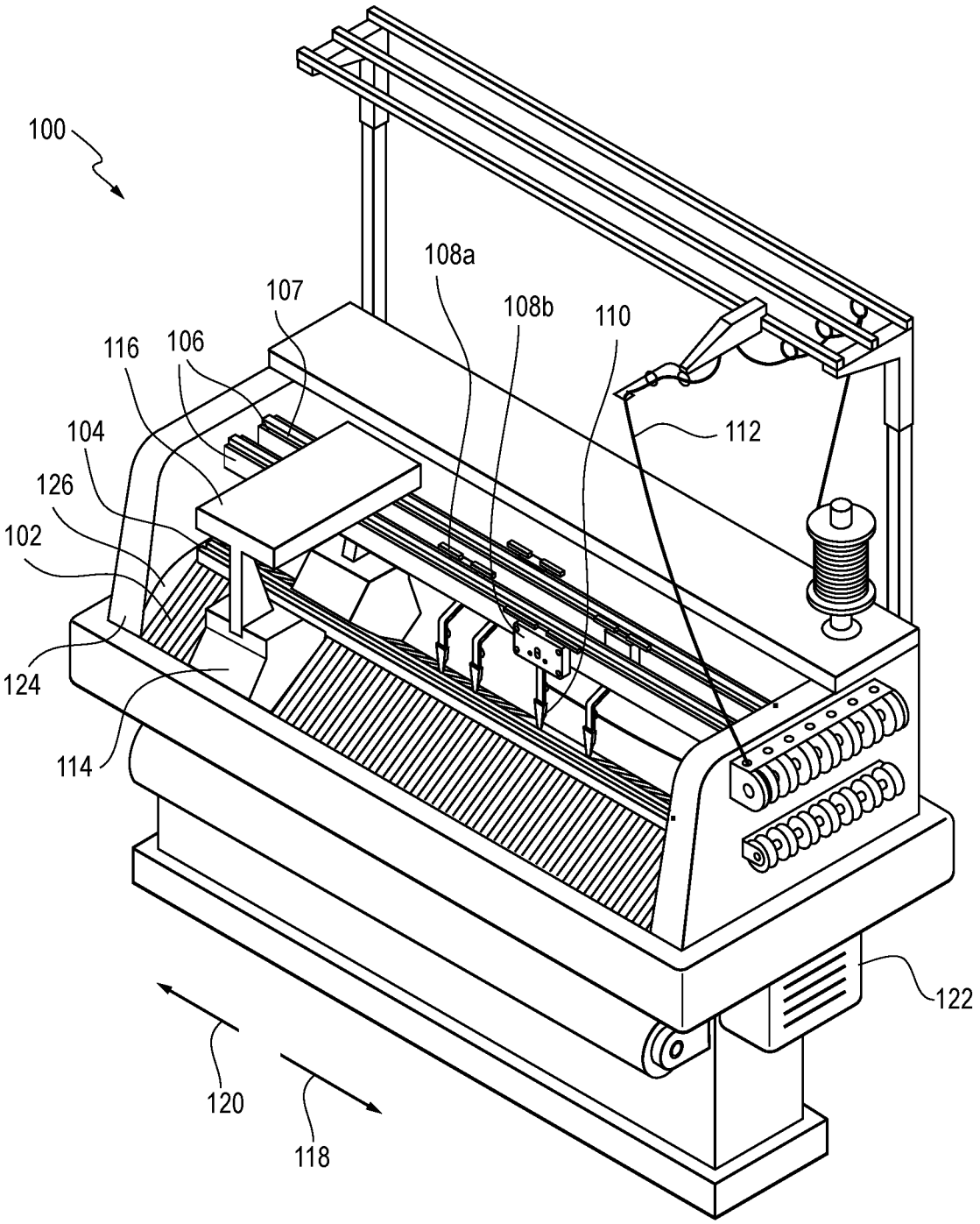
FIG. 1 is an illustration showing a perspective view of a knitting machine having extreme racking capability in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

One general aspect of the present disclosure includes a method, the method including knitting a first portion of a knitted component on a first region of a knitting machine, knitting a second portion of the knitted component on a second region of the knitting machine, moving the first portion of the knitted component towards the second portion of the knitted component by moving a first needle bed of the knitting machine relative to a second needle bed of the knitting machine, and knitting at least one course with the knitting machine that connects the first portion of the knitted component to the second portion of the knitted component.

Without limitation, the method may further include transferring at least one loop of the first portion of the knitted component from the second needle bed to the first needle bed prior to moving the first needle bed relative to the second needle bed. Without limitation, the method may further include transferring at least one loop of the second portion of the knitted component from the first needle bed to the second needle bed prior to moving the first needle bed relative to the second needle bed. Without limitation, the method may further include knitting a third portion of the knitted component after connecting the first portion of the knitted component to the second portion of the knitted component, where the third portion of the knitted component includes at least one double-jersey knit structure. Without limitation, the method may further include knitting a fourth portion of the knitted component and connecting the fourth portion of the knitted component to the third portion of the knitted component with a second connection course formed on the knitting machine. The first portion of the knitted component may be formed with a first feeder, where the second portion of the knitted component is formed with a second feeder, and where the third portion of the knitted component is formed with at least one of the first feeder and the second feeder. Alternatively, the first portion of the knitted component is formed with a first feeder, where the second portion of the knitted component is formed with a second feeder, and where the third portion of the knitted component is formed with a third feeder. The at least one course may be formed on both of the first needle bed and the second needle bed. In some embodiments, movement of the first needle bed is relative to the second needle bed is controlled by a programmed actuator. Without limitation, the method may further include using a computing interface to input electronic instructions to the actuator. The knitted component may include an upper for an article of footwear, where at least one of the first portion and the second portion forms a tongue. The first portion of the knitted component may include a double-jersey knit structure at a location adjacent to the at least one course. The second portion of the knitted component may include a double-jersey knit structure at the location adjacent to the at least one course. The at least one course may include a connection course, where the location is located immediately adjacent to the connection course in a direction perpendicular the course-wise direction.

Another general aspect of the present disclosure includes a knitted component. Without limitation, the knitted component may have a first portion and a second portion, where at least one of the first portion and the second portion includes a double-jersey knit structure. At least one connection course may secure the first portion to the second portion, where the at least one connection course extends longitudinally in a first direction, where in a flat orientation, the first portion overlaps the second portion at a location immediately adjacent to the connection course in a second direction, and where the second direction is perpendicular to the first direction.

Optionally, the first portion of the knitted component may include a double-jersey knit structure and the second portion may additionally or alternatively include a double jersey knit structure. The connection course may include a double-jersey knit structure. In some embodiments, the knitted component forms an upper for an article of footwear, where at least one of the first portion and the second portion forms a tongue of the upper.

Another general aspect of the present disclosure includes an upper for an article of footwear. The upper may include a knitted component with a first portion and a tongue secured via a connection course of the knitted component, where a forward terminus of the tongue is coextensive with the first portion and overlaps the first portion such that it is covered by the first portion from an external perspective. In some embodiments, the forward terminus of the tongue includes a double-jersey knit structure. An area of the first portion that overlaps the forward terminus of the tongue may additionally or alternatively include a double-jersey knit structure. The connection course may additionally or alternatively include a double-jersey knit structure.

Another general aspect of the present disclosure relates to a knitting machine. The knitting machine may include a first needle bed with a first plurality of needles, a second needle bed with a second plurality of needles, where the first plurality of needles and the second plurality of needles define an intersection axis. The knitting machine may further include an actuator for moving at least one of the first needle bed and the second needle bed in a direction parallel to the intersection axis, where the first needle bed is displaceable relative to the second needle bed, via the actuator, a distance greater than a length containing at least five consecutive needles of the first needle bed.

In some embodiments, the actuator may be capable of moving the first needle bed and the second needle bed relative to a frame member of the knitting machine. The first needle bed may be movable relative to the second needle bed, via the actuator, a distance greater than a length containing at least twenty consecutive needles of the first needle bed. The actuator may include a motor, and/or the actuator may be operable to move at least one of the first needle bed and the second needle bed while at least one of the first needle bed and the second needle bed performs a knitting process.

FIG. 1 shows a knitting machine 100 in accordance with certain aspects of the present disclosure. The knitting machine 100 may include two needle beds (a front or first needle bed 102 and a back or second needle bed 104) that are angled with respect to each other (e.g., thereby forming a V-bed). The needles of the first needle bed 102 may lay on a first plane, and the needles of the second needle bed 104 may lay on a second plane. The first plane and the second plane may be angled relative to each other and meet to form an intersection (or axis) that extends along a majority of a width of the knitting machine 100. The needles each may have a first or neutral position where they are retracted and a second or extended position where they are extended. In the neutral position, an end of the needles is spaced from the intersection, and in the extended position, the needles pass through the intersection. The needles, needle beds, and intersection are described in additional detail in U.S. patent application Ser. No. 13/048,540, patented as U.S. Pat. No. 9,060,570, which is herein incorporated by reference in its entirety.

One or more rails 106 may extend above and parallel to the intersection and may provide attachment points for one or more feeders 108. Herein, the rails 106 are defined by a track for which a feeder 108 may couple to in a movable manner. The rails 106 may be secured to a body 107, where the body 107 includes a rail 106 on each side (e.g., on two sides as shown) (and where each of the rails 106 are configured to couple to a different feeder 108). Two rails 106 are included in the depicted embodiment, but more or fewer than two rails 106 may be included. The feeders 108 may include a dispensing area 110 located near the intersection and configured to dispense a yarn 112 to at least one of the first needle bed 102 and the second needle bed 104 as it moves along the intersection.

The knitting machine 100 may include a carriage 114 (also called a cam box) that is movable along the first needle bed 102 and the second needle bed 104. An upper portion 116 of the carriage 114 may include a set of plungers (described in more detail below) that can selectively engage at least one of the feeders 108 such that the feeder 108 that is engaged moves along one of the rails 108 as the carriage 114 moves. As the carriage 114 moves along the first needle bed 102 and the second needle bed 104, the carriage 114 may selectively actuate needles of the first needle bed 102 and/or the second needle bed 104 such that the actuated needles move from the default position to the extended position. The actuation may be the result of a set of cams (not shown in FIG. 1) of the carriage 114 making contact with a butt portion of the needles and forcing the needles to move from the default position to the extended position as the carriage 114 passes. Due to the action of the carriage 114, the feeder 108, and the needles, the yarn 112 may be dispensed from the feeder 108 and to the needles of at least one of the first needle bed 102 and the second needle bed 104.

In some embodiments, the knitting machine 100 may have needle beds that are movable relative to each other. For example, the first needle bed 102 and the second needle bed 104 may be movable in a first direction 118 and/or a second direction 120. The first direction 118 and the second direction 120 may be parallel to the longitudinal axis defining the operation or knitting location of the needles of the knitting machine 100 (which may be an intersection point be of needles respectively from the first needle bed 102 and the second needle bed 104, for example), and therefore also parallel to the course-wise direction (or longitudinal dimension of courses) when the knitting machine is operating. Such movement may be referred to as "racking." While some existing machines are capable of slight racking (e.g., with total displacement of one needle bed relative to the other being up to a distance containing about 3 needles on one of the needle beds), such racking is primarily limited in purpose to calibration and alignment functions during machine setup along with forming knit wedges. By contrast, in the present embodiments, the knitting machine 100 may be capable of racking an extreme amount (e.g., offsetting by the distance containing 10 consecutive needles or more), and such racking may be utilized during knitting to form novel embodiments of knitted components as described in detail below.

The movement of the first needle bed 102 relative to the second needle bed 104 may be controlled via an actuator 122. In some embodiments, the actuator 122 may include an electric motor. The electric motor may be controlled, for example, by a computing interface, dials, switches, etc. (not shown in FIG. 1). Alternatively, the actuator 122 may comprise a manual input for moving the first needle bed 102 and/or the second needle bed relative to one another. For example, the manual input may comprise one or more levers, rotatable shafts, etc. (not shown in FIG. 1) for manipulation by an operator. Those skilled in the art will appreciate that the actuator 122 may be operatively connected to the first needle bed 102 and/or the second needle bed 104 by any means suitable for transmitting linear movement, including, for example, one or more shafts, gears, or linkages, and that transmission of the rotational and/or linear movement to the first needle bed 102 and/or the second needle bed 104 may result in rotation of the needle bed(s), linear movement of the needle bed(s), or a combination of both rotation and linear movement of the needle bed(s), as further described below.

In some embodiments, other components of the knitting machine 100 may be designed to accommodate extreme racking movement of at least one of the first needle bed 102 and the second needle bed 104. For example, frame members and walls of the knitting machine 100 (e.g., the depicted wall 124) may be removed (e.g., with reference to existing machine), moved, may include openings for receiving a needle bed (e.g., opening 126), and/or may be otherwise redesigned such that they do not inhibit movement of the needle beds 102, 104 along the first direction 118 and/or the second direction 120. Thus, in certain embodiments, the first needle bed 102 may be movable/displaceable relative to the second needle bed 104 (through movement of one or more of the beds) for a distance that is equal to, or greater than, the distance containing five consecutive needles on one of the needle beds (e.g., such as a distance greater than or equal to the distance containing at least 10 needles, 20 needles, 50 needles, or even 100 needles or more on a needle bed).

This racking capability may provide the knitting machine 100 with the ability to form knitted components with enhanced structures relative to previously-known varieties. For example, the knitting machine 100 of FIG. 1 may be capable of forming a knitted component 130 having two portions, each with a double-jersey knit structure, that overlap and connect with at least one connection course. To illustrate, and referring to FIG. 2, a first portion 152 of a knitted component 130 may be formed at least partially on a first needle bed 102, and a second portion 154 of the same knitted component 130 may be formed on a second needle bed 104. During initial formation of the first portion 152 and the second portion 154 of the knitted component 130, the first portion 152 and the second portion 154 may be offset (e.g., may be free from overlapping each other). While not shown explicitly in FIG. 2, one skilled in the art will understand that, since the two portions do not overlap from a front perspective, the first portion 152 and/or the second portion 154 may each be formed on both needle beds 102, 104. In other words, the first portion 152 and the second portion 154 shown in FIG. 2 may each have a double-jersey knit structure, herein defined as a knit structure formed using at least one needle from each of two needle beds in a single course. Thus, the formation of the first portion 152 and/or the second portion 154 with double-jersey knit structures may utilize the full capacity of two needle beds of the knitting machine 100, which may provide the ability for each of the knit portions to have a relatively enhanced complexity for providing certain physical and/or visual characteristics (e.g., a relatively strong, inelastic, and durable structure) in addition to inlaid yarns/strands and/or other features not possible or impractical for formation on only one needle bed. A single-jersey knit structure, by contrast, is defined herein as a knit structure having a course formed using the needles of only one needle bed.

The first portion 152 and the second portion 154 of the knitted component 130 may be formed with a common feeder or different feeders. For example, referring to FIG. 1 and FIG. 2, a first feeder 108*a* (and potentially additional feeders) may be used to form the first portion 152, and a second feeder 108*b* (and potentially additional feeders) may be used to form the second portion 154. Advantageously, using different feeders may provide the first portion 152 and the second portion 154 with different characteristics (e.g., by dispensing different yarns from the respective feeders), may reduce knitting time relative to processes using a common feeder, etc. If multiple feeders are used simultaneously, the knitting machine 100 may include separate actuation devices for simultaneous operation. For example, the feeders of the knitting machine 100 may be individually driven (e.g., via a belt-drive), more than one carriage 114 (FIG. 1) may be included, etc.

After formation of the first portion 152 and the second portion 154 of the knitted component 130, the first portion 152 and/or the second portion 154 may be prepared for being moved via movement of at least one of the needle beds 102, 104. For example, a transfer technique may be initiated to move all of the loops 136 of the first portion 152 to the first needle bed 102 and/or to move all of the loops 138 of the second portion 154 to the second needle bed 104. As would be understood by those of ordinary skill in the art, this transfer step frees the first portion 152 from the second needle bed 104 (e.g., such that no loops of the first portion 152 are held by needles of the second needle bed 104) and also frees the second portion 154 from the first needle bed 102. Importantly, since after such a transfer step, the second needle bed 104 can move relative to the first portion 152 of the knitted component 130 without pulling on, stretching, distorting, or otherwise interfering with the knit structure of the first portion 152 of the knitted component 130. The same is true of movement of the first needle bed 102 relative to the second portion 154 of the knitted component 130.

Figure 3:
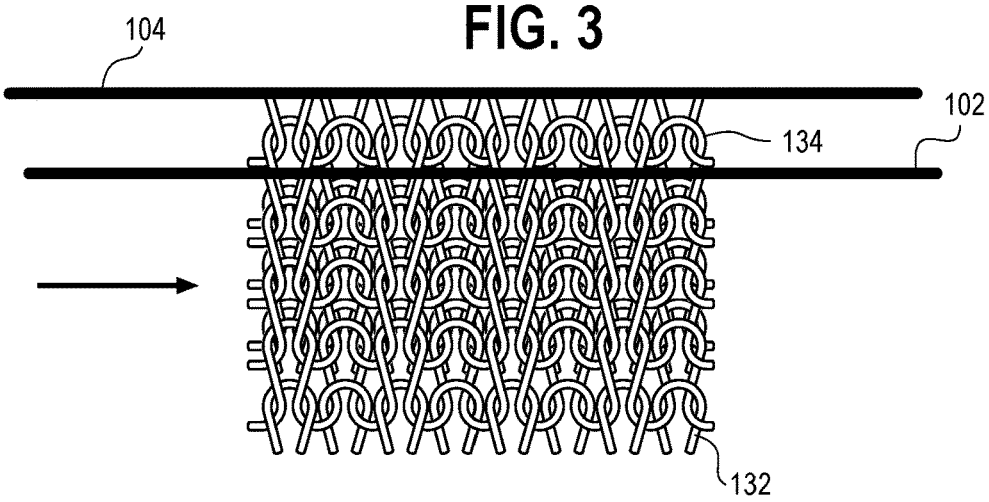
FIG. 3 is an illustration showing the knitted component of FIG. 2, where the first and second portions of the knitted component are aligned on the knitting machine after racking at least one needle bed in accordance with certain aspects of the present disclosure.

Referring to FIG. 3, once the first portion 152 and the second portion 154 are formed and their loops transferred to the respective first needle bed 102 and second needle bed 104, the first portion 152 and the second portion 154 can be moved into alignment (e.g., such that they overlap from the front perspective of FIG. 3). This movement may occur due to movement of the first needle bed 102 relative to the second needle bed 104. Such movement may occur automatically (e.g., via a programmed actuator as described above) or manually (e.g., through user-actuated movement via a hand-crank or other suitable means). While knitting may halt during this movement, it will be appreciated that single-jersey knitting may continue to occur during this movement.

Figure 4:
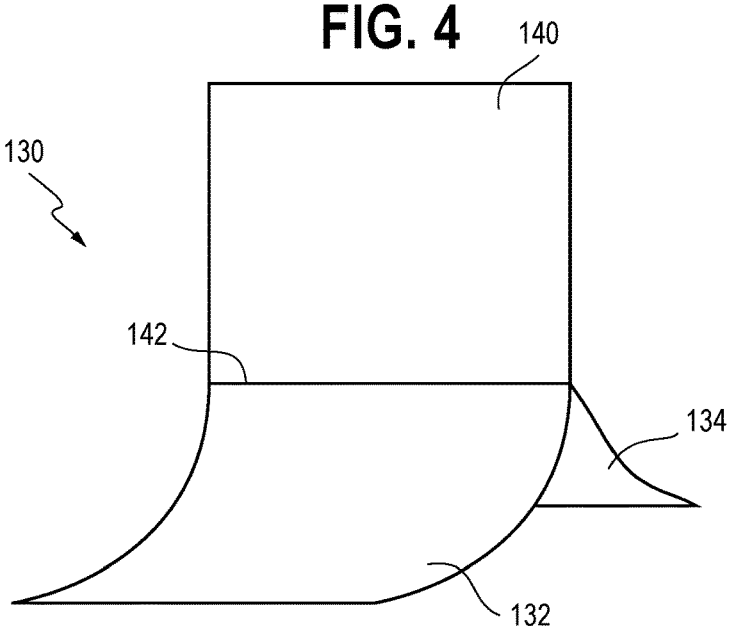
FIG. 4 is an illustration showing the knitted component of FIGS. 3-4 after completion of the knitting process and removal from the knitting machine.

Once the first portion 152 and the second portion 154 of the knitted component 130 are moved such that they at least partially overlap on the knitting machine 100 (as shown in FIG. 4), one or more connection courses may be formed to secure the first portion 152 to the second portion 154. Then, the knitting machine 100 may continue to knit the knitted component 130 thereby forming a third portion 140 (which may have a double-jersey knit structure). Once knitting is complete, and referring to FIG. 5, the knitted component 130 may therefore have a first portion 152 and a second portion 154 that overlap in a flat orientation, each having a double-jersey knit structure. When in such a flat orientation, the first portion 152 and the second portion 154 may form separable layers, where each layer has a double-jersey knit structure. Further, the first portion 152 and the second portion 154 may overlap at a location immediately adjacent to the connection course (at least when in a flat orientation), including in a location immediately adjacent to the connection course 142 in a direction 155 (which is perpendicular the course-wise direction). That is, if the course-wise direction extends along the longitudinal axis of the connection course 142, the first portion 152 overlaps the second portion 154 at a location 157 that is immediately adjacent to the connection course 152 in the direction 155, where the direction 155 is perpendicular to the course-wise direction.

The connection course(s) 142 may secure the first portion 152 to the second portion 154, and in some embodiments may be the terminus of a separate third portion 140 of the knitted component 130. While not shown, it is contemplated that the process described above may be repeated multiple times to form a knitted component having more than two layers, and/or different areas where each of the different areas has multiple layers. For example, a fourth portion of the knitted component (not shown) may be formed, and the fourth portion of the knitted component may be moved relative to the third portion of the knitted component and then connected to the third portion with a connection course formed on the knitting machine.

The knitting process described above, made possible by the knitting machine 100 of FIG. 1 having extreme racking capability, may be advantageous for forming a variety of knitted components. For example, the capabilities of the knitting machine 100 may be beneficial for forming enhanced uppers configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

Figure 6:
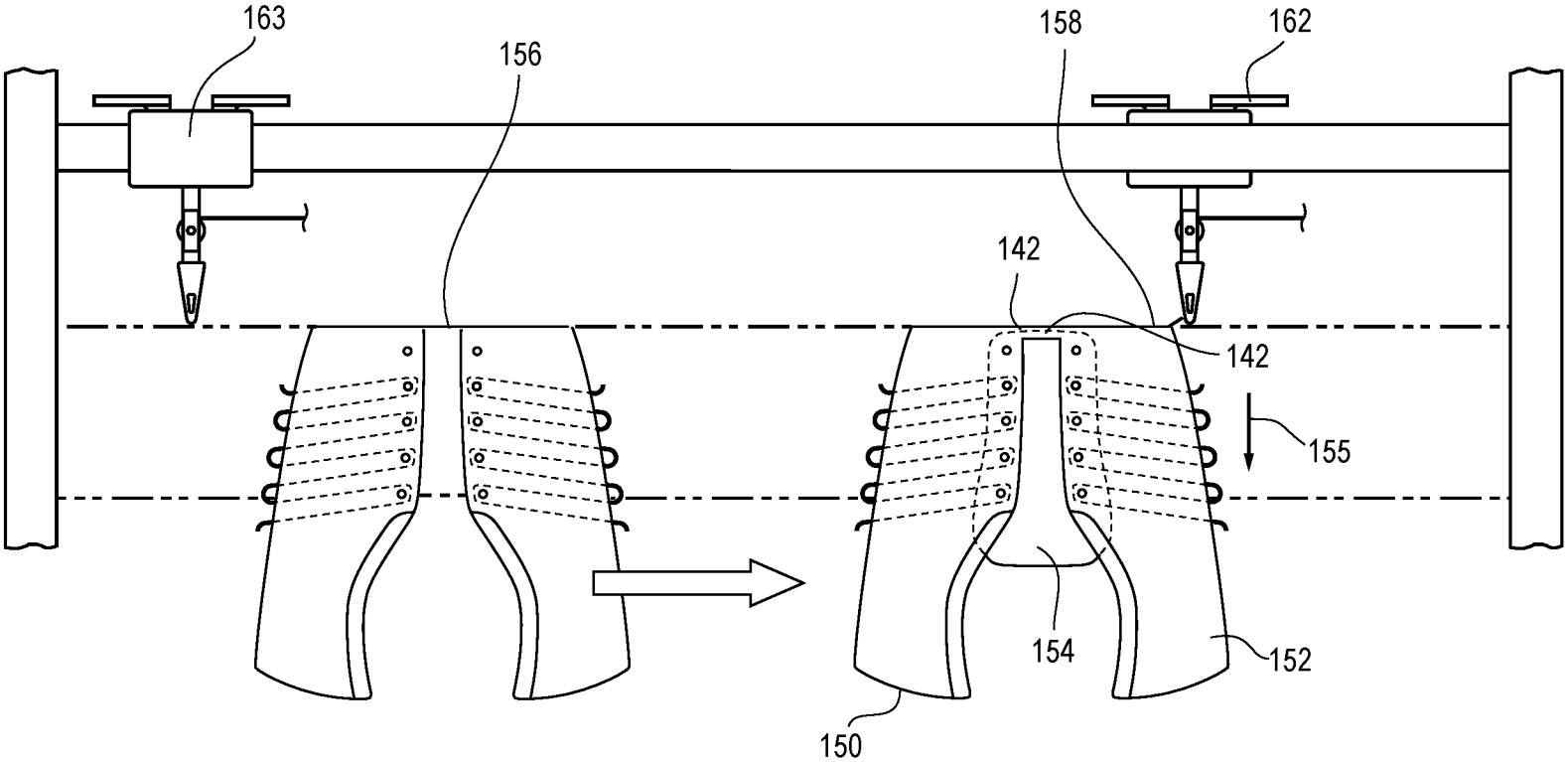
FIG. 6 is an illustration showing the first and second portions of the upper from FIG. 5 after being secured on the knitting machine in accordance with certain aspects of the present disclosure.

To illustrate, and referring to FIG. 5 and FIGS. 6A-B, a first portion 152 of an upper 150 may be formed in a first location 156 of the knitting machine 100, as shown. A first feeder 160 (at least) may be utilized to form the first portion 152. Similarly, a second portion 154 of the upper 150 may be formed in a second location 158 of the knitting machine 100, and a different second feeder 162 (at least) may be used. In the depicted example (which is non-limiting), the first portion 152 may form the majority of the outer surface of an upper, and the second portion 154 may form the tongue of the upper. When the second portion 154 forms a tongue, a forward terminus of the tongue (e.g., within area 157) may be coextensive with the first portion 152, and may overlap the first portion 152, such that the forward terminus of the tongue is covered by the first portion 152 from an external perspective.

Each of the first portion 152 and the second portion 154 may be formed with a double-jersey knit structure utilizing a first set of needles 166 of the first needle bed 102 and a second set of needles 168 of the second needle bed 104. Advantageously, using two needle beds (i.e., double-jersey knitting) may provide an enhanced knit structure with suitable strength, durability, and desirable visual characteristics. Further, double jersey knitting may provide the ability for inlaying at least one tensile strand 170 within a course during the knitting process. One example of inlaying is described in U.S. patent application Ser. No. 13/048,527, filed on Mar. 15, 2011, and patented as U.S. Pat. No. 8,522,577, which is hereby incorporated by reference in its entirety. While not shown, the second portion 154 of the upper 150 could also include one or more inlaid strands or other elements.

Figure 2:
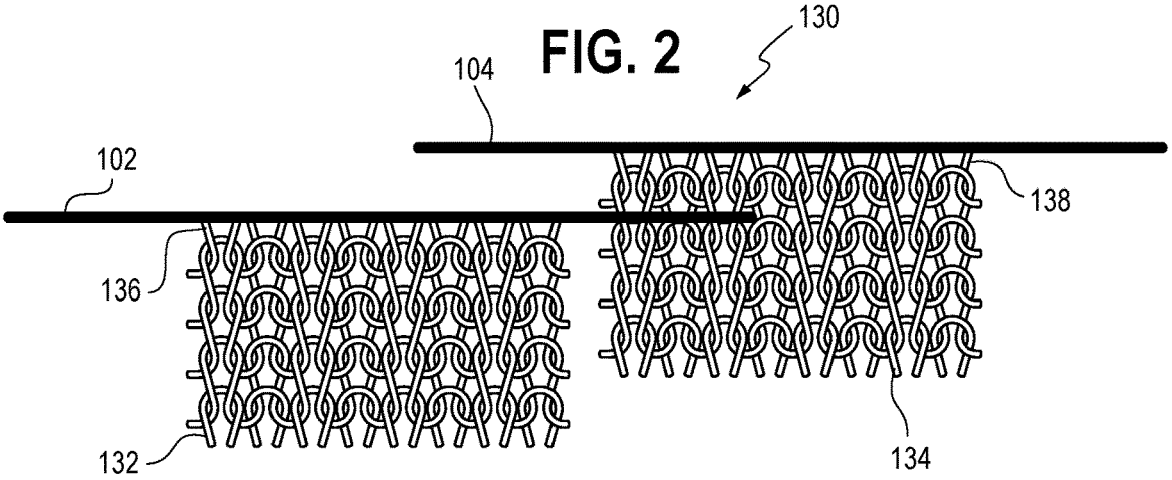
FIG. 2 is an illustration showing first and second portions of a knitted component being held on needles of a first and second needle bed, respectively, during a knitting process in accordance with certain aspects of the present disclosure.

Once the first portion 152 and the second portion 154 are formed, all of the outstanding loops of the first portion 152 that are on the second needle bed 104 of the knitting machine may be transferred to the first needle bed 102 (see FIG. 2, for example). Similarly, all of the outstanding loops of the second portion 154 that are on the first needle bed 102 may be transferred to the second needle bed 104 (similar to as shown in FIG. 2). Then, referring to FIG. 6, the first portion 152 may be moved relative to the second portion 154 such that the first portion 152 and the second portion 154 at least partially overlap from a front perspective. While in FIG. 6, only one needle bed moves (e.g., moving the first portion 152 from the first location 156 to the second location 158), both needle beds may move, and/or only the other needle bed may move. Once the components of the upper 150 are in their desired positions, one or more connection courses 142 may then be formed on the first needle bed 102 and the second needle bed 104 to secure the first portion 152 and the second portion 154 together. It is contemplated that the connection courses may be formed using the first feeder 160 (FIG. 5) and/or the second feeder 162, but a separate feeder may alternatively be used (such as feeder 163), particularly if it is desirable to provide an additional portion or third portion (e.g., a toe area in the depicted example) with yarns of different materials.

Advantageously, the first portion 152 and the second portion 154 may be secured together on the knitting machine and without necessitating sewing or otherwise attaching the portions together after the knitting process. That is, the knitting process on the knitting machine may substantially secure the two portions together and also may form the remainder of the upper 150 without the need for significant post-knitting processes or steps. Such an embodiment may display enhanced strength and durability relative to other embodiments, and substantially completing formation during one process (e.g., on the knitting machine) may increase manufacturing efficiency and/or reduce manufacturing costs, thus lowering the overall cost to consumers. This contrasts with embodiments where two or more portions are formed separately as distinct knitted components and then later secured to each other after knitting.

Figure 7:
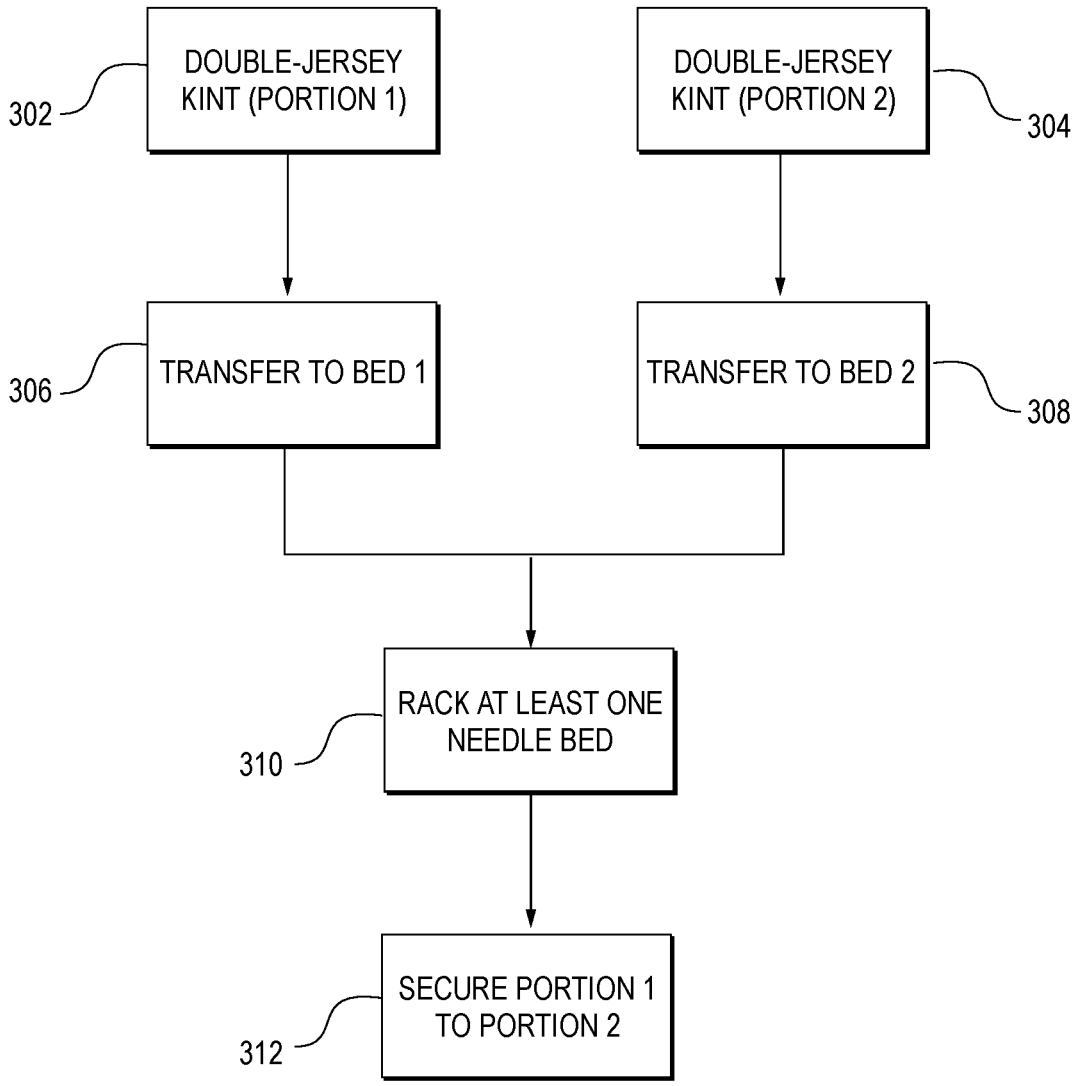
FIG. 7 is a flow diagram showing certain steps of a method of forming a knitted component in accordance with certain aspects of the present disclosure.

FIG. 7 shows a flow diagram that depicts certain steps of a method for forming a knitted component on a knitting machine in accordance with the aspects discussed above. Additional steps may be included (and/or some left out), and therefore the flow diagram of FIG. 7 is not intended to be exhaustive. Referring to FIG. 7, steps 302 and 304 may include knitting a first portion of a knitted component and a second portion of a knitted component. Each of the first portion and the second portion may include a double-jersey knit structure, and formation of the first portion and the second portion may occur simultaneously (e.g., with different feeders in some embodiments). In steps 306 and 308, each of the first portion and the second portion of the knitted component may be transferred to a respective needle bed such that the needle beds can move relative to one-another without distorting and damaging the two knit portions. In step 310, one of the needle beds of the knitting machine may be moved relative to the other (e.g., "racking") to align the two knit portions on the knitting machine. Finally, in step 312, the first portion and the second portion may be secured, while still on the knitting machine, by knitting at least one connection course.

The present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

I claim:

1. A method, comprising:

knitting, with a first feeder, a first portion of a knitted component on a first region of a knitting machine, wherein the first portion of the knitted component is one of a medial side or a lateral side of the knitted component;

knitting, with a second feeder, a second portion of the knitted component on a second region of the knitting machine, wherein the second portion of the knitted component is a tongue portion of the knitted component;

moving the first portion of the knitted component towards the second portion of the knitted component by moving a first needle bed of the knitting machine relative to a second needle bed of the knitting machine; and knitting at least one course with the knitting machine that connects the first portion of the knitted component to the second portion of the knitted component.

2. The method of claim 1, further comprising transferring at least one loop of the first portion of the knitted component from the second needle bed to the first needle bed prior to moving the first needle bed relative to the second needle bed.

3. The method of claim 2, further comprising transferring at least one loop of the second portion of the knitted component from the first needle bed to the second needle bed prior to moving the first needle bed relative to the second needle bed.

4. The method of claim 1, further comprising knitting a third portion of the knitted component after connecting the first portion of the knitted component to the second portion of the knitted component, wherein the third portion of the knitted component includes at least one double-jersey knit structure.

5. The method of claim 4, further comprising knitting a fourth portion of the knitted component and connecting the fourth portion of the knitted component to the third portion of the knitted component with a second connection course formed on the knitting machine.

6. The method of claim 4, wherein the third portion of the knitted component is formed with at least one of the first feeder and the second feeder.

7. The method of claim 4, wherein the third portion of the knitted component is formed with a third feeder.

8. The method of claim 1, wherein the at least one course is formed on both of the first needle bed and the second needle bed.

9. The method of claim 1, wherein the movement of the first needle bed is relative to the second needle bed is controlled by a programmed actuator.

10. The method of claim 9, further comprising using a computing interface to input electronic instructions to the actuator.

11. The method of claim 1, wherein the first portion of the knitted component includes a double-jersey knit structure at a location adjacent to the at least one course, and wherein the second portion of the knitted component includes a double-jersey knit structure at the location adjacent to the at least one course.

12. The method of claim 11, wherein the at least one course includes a connection course, and wherein the location is located immediately adjacent to the connection course in a direction perpendicular the course-wise direction.

* * * * *